US007625253B2

(12) United States Patent
Eppe et al.

(10) Patent No.: US 7,625,253 B2
(45) Date of Patent: Dec. 1, 2009

(54) INSTALLATION SWITCHING DEVICE

(75) Inventors: Klaus-Peter Eppe, Weinheim (DE); Carola Thielen, Birkenau-Löhrbach (DE); Albert Stieger, Plankstadt (DE); Richard Hack, Nussloch (DE)

(73) Assignee: ABB Patent GmbH, Ladenburg (DE)

( * ) Notice: Subject to any disclaimer, the term of this patent is extended or adjusted under 35 U.S.C. 154(b) by 223 days.

(21) Appl. No.: 11/907,952

(22) Filed: Oct. 18, 2007

(65) Prior Publication Data

US 2008/0108254 A1 May 8, 2008

(30) Foreign Application Priority Data

| | | |
|---|---|---|
| Oct. 21, 2006 | (DE) | 10 2006 049 772 |
| Sep. 13, 2007 | (DE) | 10 2007 043 801 |
| Sep. 14, 2007 | (DE) | 10 2007 044 069 |
| Sep. 17, 2007 | (DE) | 10 2007 044 262 |

(51) Int. Cl.
*H01R 4/48* (2006.01)

(52) U.S. Cl. ..... 439/835

(58) Field of Classification Search ..... 439/828, 439/834–835, 839, 846, 784–786, 729, 188
See application file for complete search history.

(56) References Cited

U.S. PATENT DOCUMENTS

| | | | | |
|---|---|---|---|---|
| 6,283,801 | B1 * | 9/2001 | Guinda et al. | 439/835 |
| 6,464,545 | B2 * | 10/2002 | Yano | 439/828 |
| 2004/0082229 | A1 * | 4/2004 | Bouley et al. | 439/834 |

FOREIGN PATENT DOCUMENTS

| | | |
|---|---|---|
| EP | 1 432 077 A1 | 6/2004 |
| EP | 1 213 791 B1 | 8/2005 |

* cited by examiner

*Primary Examiner*—Edwin A. Leon
(74) *Attorney, Agent, or Firm*—Buchanan Ingersoll & Rooney PC

(57) ABSTRACT

The invention relates to an installation switching device comprising a housing, with a front and rear face, a mounting side, front and rear narrow sides and wide sides, and with two screwless terminal connections with in each case at least one clamping spring for the connection of connecting conductors which are fixed in position in a terminal connection space of the housing. The terminal connection space is open towards the housing wide sides and towards the face. Each terminal connection is covered by an associated terminal cover part connected pivotably to the housing, which has a terminal face with a number of terminal openings corresponding to the number of connecting conductors to be connected, and guide means moulded onto each terminal opening for the connecting conductors, which also has two side areas which cover the terminal connection laterally in the direction of the wide sides. Spring actuating means are moulded onto the cover part and are constructed in such a manner that, when the cover part is swivelled against the clamping spring they load the latter so as to open it.

24 Claims, 7 Drawing Sheets

INSTALLATION SWITCHING DEVICE

RELATED APPLICATIONS

This application claims priority under 35 U.S.C. §119 to German Application No. 10 2007 044 262.0 filed in Germany on Sep. 17, 2007, German Application No. 10 2007 044 069.5 filed in Germany on Sep. 14, 2007, German Application No. 10 2007 043 801.1 filed in Germany on Sep. 13, 2007, and German Application No. 10 2006 049 772.4 filed in Germany on Oct. 21, 2006, the entire contents of which are hereby incorporated by reference in their entireties.

TECHNICAL FIELD

An installation switching device is disclosed comprising a housing and with two screwless terminal connections with in each case at least one clamping spring for the connection of connecting conductors which is fixed in position in a terminal connection space of the housing

BACKGROUND INFORMATION

A generic installation switching device comprises within its housing at least one contact point with at least one fixed and one moving contact member via which a current path leading from an input terminal to an output terminal can be opened and closed. The contact point is generally operated by a switching mechanism with latching point. A generic installation switching device can also comprise tripping devices, for example a thermal trip or an instantaneous tripping magnet which, when a short circuit or fault current occurs on the current path, act on the contact point or the switching mechanism, respectively, so that the contact point is opened.

In many generic installation switching devices, the neutral conductor is also connected in addition to the current-conducting pole. In such devices, it is then necessary that two conductors can be connected closely next to one another at the terminal connection side but remain electrically insulated from one another at the connecting point of the installation switching device.

In generic installation switching devices, screwless terminal connections are also used in addition to screw terminals for the connection to external connecting conductors. The clamping elements used can be plug-in terminals or spring-pull terminals. In principle, these can considerably simplify connection of connecting conductors but installation switching devices with screwless terminal connections, known today, have disadvantages.

From EP 1 432 077 A1, a generic installation switching device with two screwless terminal connections is known in which the terminal connection space is laterally limited by the housing wide sides and is open towards the narrow side of the housing and is covered with a fixed cover part corresponding in its width to the housing width. The cover part is clipped onto the housing at the narrow side of it. The terminal connection according to EP 1 432 077 can only be actuated with a tool for inserting flexible conductors and for removing the conductors from the terminal connection.

EP 1 213 791 B1 shows an installation switching device with two connecting elements of the spring-pull terminal type, arranged above one another and partially displaced transversely. The terminal element can only be actuated by means of an external tool.

SUMMARY

A generic installation switching device is disclosed in which two screwless terminal connections on one side of the installation switching device are allocated to one another in a common terminal connection space and the terminal connections are constructed in a simple and cost-effective manner in such a manner that the toolless insertion and removal of connecting lines becomes possible.

According to the disclosure, the terminal connection space is thus open towards the housing wide sides and towards the face and the two terminal connections are displaced with respect to one another transversely to the wide side next to one another and in height above the mounting side, and each of the two terminal connections is covered by a terminal cover part connected pivotably to the housing. Each terminal cover part has a terminal face with a number of terminal openings corresponding to the number of connecting conductors to be connected and guide means, moulded onto each terminal opening, for the connecting conductors. Furthermore, each terminal cover part has two side areas which, with the terminal cover part in place, cover the terminal connection allocated to it laterally in the direction of the wide sides.

According to an advantageous embodiment of the disclosure, spring actuating means are moulded onto the terminal cover part and are constructed in such a manner that, when the cover part is swivelled against the clamping spring, they load the latter so as to open it.

A further very advantageous embodiment of the disclosure provides that the guide means are tube-like hollow bodies forming a lead-in conduit which, at the same time, are used as spring actuating means for the clamping spring.

Each terminal connection of an installation switching device according to the disclosure comprises very few components, namely essentially only the clamping spring, a conductor bar with a clamping edge against which the clamping spring clamps the connecting conductor to be connected, and the terminal cover part. An installation switching device according to the disclosure comprises two such terminal connections which are arranged next to one another on one terminal side of the device. It can thus be produced in a very simple and cost-effective manner.

According to a particularly advantageous embodiment, the two terminal connections are also displaced against one another in height above the mounting side and are thus offset. In this manner, the clearance and leakage path between the two terminal connections is extended as a result of which the electrical insulation between the two terminal connections is protected further.

The terminal cover part is configured in such a manner that it realizes a number of functions in one component:

- The guide means moulded onto the terminal cover part at each terminal opening provide for the guidance of the connecting conductor towards the clamping spring at the desired angle of insertion. Neither the conductor bar nor the clamping spring itself need to have any further guide means for guiding the connecting conductor.
- A number of connecting conductors are inserted through a number of terminal openings and are held apart at the same time. Thus, an individual insertion of each individual conductor end is possible, even with a number of conductor ends to be clamped on, without further measures for keeping the individual conductors apart being required on the part of the clamping spring or the conductor bar.

Due to the spring actuating means moulded onto the terminal cover part at the same time in accordance with an advantageous embodiment, the terminal cover part at the same time becomes the opening tool for the clamping spring. A separate actuating tool, for example a screwdriver, is no longer required for opening the clamping spring. This greatly simplifies the insertion and removal of connecting conductors.

Overall, an installation switching device according to the disclosure has the advantage that two terminal connections are attached next to one another in a simple manner and quite easily accessibly from the outside in one terminal connection space on a connecting side, the two terminal connections being electrically insulated from one another and being able to be operated independently of one another without tools. No external tool is needed either for inserting or for removing connecting conductors with fixed and with flexible connecting ends into and out of the terminal connection, respectively. The terminal connections can be built up in a simple manner with a few prefabricated components.

According to an advantageous embodiment of the disclosure, each terminal cover part is resiliently loaded by its associated clamping spring in opposition to the direction of insertion of the external connecting conductor and can be pressed against this clamping spring. In this arrangement, the terminal cover part can be resiliently loaded by its associated clamping spring against a projection, used as stop, of the housing wall in a particularly advantageous manner. The terminal cover part is thus held in a defined initial position by the resilient loading of its associated clamping spring. The initial position is the closing position of the clamping spring in this arrangement.

The terminal cover part can be configured in a particularly simple manner and can be produced, for example, as cost-effective injection moulding.

For the pressure operation of the terminal cover part, it can be provided that the terminal cover part has a pressure area which is accessible from the outside and can be manually operated.

A further advantageous variant of the disclosure is characterized by the fact that the terminal connection space comprises between the two terminal connections an insulating plate extending in parallel with the wide sides. This prevents contact, and thus electrical contact, between the two terminal connections, for example between the two conductor bars. In addition, the insulating plate acts in a mechanically stabilizing manner.

To ensure access to the terminal connection for a voltage tester in a simple manner in the operating state, that is to say after completed assembly of the installation switching device, the terminal cover part can have a test opening for electrically contacting the terminal connection.

A further advantageous variant of the disclosure is characterized by the fact that an adjustment opening is introduced in the housing wall in the vicinity of a terminal cover part. It is thus possible to intervene, during the production or in the installed state of the completely assembled switching device, with a tool in the interior of the switching device in order to access an adjusting means arranged there in the vicinity of the adjustment opening.

With respect to the spatial arrangement of the terminal face of the terminal cover part with reference to the face of the housing and of the guide means compared with the terminal face, a possible embodiment of the disclosure provides that the terminal face of the terminal cover part extends approximately in parallel with the rear face and the guide means are inclined with respect to the terminal face of the terminal cover part. The angle of inclination for the guide means is selected, for example, in accordance with the aspect that the connecting conductors remain easily accessible in the case of the series installation of an installation switching device according to the disclosure, for example in a distributor box, and the connecting conductors are not kinked upwards too much.

In this respect, a further advantageous embodiment provides that the terminal face of the terminal cover part is inclined with respect to the rear face and the guide conduits extend approximately perpendicularly to the terminal face. The angle of inclination, at which the connecting conductors are inserted relative to the spring terminal, is determined by the angle of inclination of the guide conduits in this embodiment.

Naturally, a combination of the two possibilities shown above would be conceivable in which both the terminal face of the terminal cover part is inclined with respect to the rear face and the guide conduits are inclined with respect to the terminal face.

To be able to operate the spring terminal by means of an external tool additionally on demand, for example for reasons of redundancy, the terminal cover part can have an access opening for an actuating tool according to a further embodiment of the installation switching device according to the disclosure. The clamping spring can then be brought into its opening position by means of the actuating tool, for example a screwdriver, through this access opening.

According to a further, very advantageous embodiment, a closing part, which in each case covers the terminal connection space at the face in collaboration with a housing-fixed face end, is coupled pivotably to the free end, pointing towards the face, of a first part-body of each terminal cover part, wherein the closing part at least partially overlaps the housing-fixed face end on actuation of the terminal cover part.

The respective closing part and the housing-fixed part of the face together form the face. The respective closing part thus acts as part, at the terminal cover part side, of the face as supplement to the housing-fixed part.

According to a particularly advantageous embodiment, the closing part is constructed to be plate shaped. In this arrangement, it can be advantageously produced in the same injection moulding process as the terminal cover part.

An embodiment is particularly very advantageous in which the respective closing part is coupled to the respective terminal cover part by means of a hinge, for example a film hinge. Such a film hinge can be produced very advantageously by injection moulding.

A further very advantageous embodiment of the disclosure is characterized by the fact that the respective closing part is in each case guided displaceably in parallel with the face over guide pins, projecting laterally, in a housing-fixed rocker-like guide. The respective closing part is then carried overlapping the respective associated part at the housing side of the face and displaceably. As a result, it can be swivelled behind the respective associated part at the housing side of the rear face on operation of the respective terminal cover part and displaced. This ensures tight covering of the terminal receiving space towards the face with simultaneous mobility of the terminal cover part and mechanical stability of the rear face.

By attaching the hinge to the respective closing part, the latter can move parallel to the face in a rocker-like guide in a space-saving manner.

A development of the disclosure which is also very advantageous is characterized by the fact that the respective terminal cover part, following the terminal face, carries a spacing area which forms the closure, at the side terminal cover part, of the terminal receiving space in the area of the respective narrow side, the closing part being pivotably coupled to the end, pointing toward the face, of the spacing area. This makes it possible to move the terminal face into a part of the narrow side wall of the switching device which is closer to the mounting side if this is required due to a predetermined arrangement of the connecting terminals in the interior of the switching device close to the mounting side.

According to a particularly advantageous development of this embodiment, the spacing area is constructed to be stiff. This makes it possible to transmit a force to the spring of the connecting terminal also by operating the terminal cover part over the spacing area. This is advantageous if the pressure area of the terminal cover part, due to the position of the connecting terminal very close to the mounting side of the switching device in the installed position of the switching device, for example in an installation distributor, is now only accessible with difficulty by an operating person. The spacing area can thus be used as second pressure area for operating the spring in an area which is not covered by a connecting conductor.

In a particularly advantageous further embodiment of the disclosure, the spacing area carries an access opening for an operating tool. The connecting terminal can thus be operated either manually or also by means of a tool via the terminal cover part.

According to a further, very advantageous embodiment of the disclosure, the respective closing part consists, at least in the area of the coupling to the first part-body, of a material which has different mechanical properties from the first part-body of the terminal cover part.

Here, too, the closing part covers the terminal connection space at the face in collaboration with a housing-fixed face end, the closing part at least partially overlapping the housing-fixed face end on operation of the terminal cover part.

The respective closing part and the housing-fixed part of the face together thus form the face. As a supplement to the housing-fixed part, the respective closing part thus acts as a part at the terminal cover part side of the face.

In this arrangement, an embodiment is particularly advantageous in which the hinge and the respective closing part consist, in the area of the hinge, of a material which has different mechanical properties from the first part-body of the terminal cover part.

Due to the fact that the respective closing part consists, at least in the area of the coupling to the first part-body of the terminal cover part, of a material having other mechanical properties than the latter, the spring-elastic characteristics of the respective closing part and its coupling in each case to the first part-body can be specified independently of those in each case of the first part-body of the terminal cover part and optimized for the application. This is of advantage especially if different, in some cases even opposite, mechanical demands are made respectively on the first part-body of the terminal cover part than on the closing part.

This can be the case if the respective terminal cover part, with an actuation, that is to say a swivelling into the interior of the switching device, simultaneously actuates its respective clamping spring in a manner so as to open it in opposition to its restoring spring force.

This can be effected, for example, by spring actuating means moulded onto the respective terminal cover part in a suitable position, which act on the clamping spring during a swivelling of the terminal cover part.

In this case, the first part-body of the respective terminal cover part can have a high stiffness so that the force for opening the respective clamping spring can be transferred without deformation of the respective terminal cover part.

However, the respective closing part should be flexible, but at least coupled flexibly to the first part-body of the terminal cover part so that it can slide in a space-saving manner behind the housing-fixed face end in the rocker-like guides during the swivelling of the terminal cover part.

When the respective terminal cover part is swivelled into the device interior, the angle between the closing part and the first part-body of the respective terminal cover part is forced to change.

This is because the closing part should extend as parallel as possible to the housing-fixed face end. But the angle between the first part-body of the terminal cover part and the housing-fixed face end then changes when the terminal cover part is swivelled. A mobility of the closing part with respect to the first part-body of the terminal cover part, which can only be achieved by a flexibility of the material at this point, is therefore required at the coupling point.

According to a particularly advantageous development of the disclosure, the spacing area is constructed to be stiff and the closing part is constructed of a soft material, which is softer than the spacing area, at least in the area of the coupling to the spacing area.

This meets the two contradictory requirements for different part-bodies of the terminal cover part. A single component, the respective terminal cover part, has different material properties in different areas. Due to the stiff part-area, a force can be transmitted to the respective spring of the connecting terminal also by actuating the terminal cover part over the spacing area. The closing part, the second part-area, however, can be bent away easily and shifted in parallel with the front faces and behind these.

In a particularly advantageous embodiment of the disclosure, the terminal cover part with the closing part coupled thereto is produced in a two-component injection moulding process. In this process, materials having different mechanical properties, that is to say, for example, hard and soft plastics, can be joined during the injection moulding.

With respect to an advantageous embodiment of the terminal connection, each terminal connection of an installation switching device according to the disclosure comprises a clamping spring, acting as compression spring on the conductor end, for clamping the conductor end tightly at an abutment, the terminal connection comprising a conductor bar with a connecting end and an adjoining discharge area. The conductor bar has at the connecting end a window-like opening with a support edge and a clamping edge, opposite the support edge, at the transition of the connecting end into the discharge area. The clamping spring also has a support leg with which it is supported on the support edge of the conductor bar. The support leg is adjoined by an arc piece which is adjoined by a clamping leg so that the conductor end can be clamped tight between the clamping leg and the clamping edge as abutment. The conductor end can be inserted into the window-like opening from the side of the arc piece.

According to an advantageous embodiment of the disclosure, the respective arc piece is adjoined by a first part-clamping leg which, at a bending edge, changes into a second part-clamping leg bent away from the respective first part-clamping leg so that the first and the second part-clamping leg, in each case, assume an obtuse angle to one another, the opening of which points into the direction of insertion of the connecting conductor.

The obtuse angle between the, in each case, first and the, in each case, second part-clamping leg provides the advantage that the point of attack can be placed in the vicinity of the spring actuating means in the vicinity of the bending edges. As a result, the resting point of the spring actuating means can have a greater distance from the point of rotation of the clamping leg at the arc piece without the maximum terminal opening, which can be achieved as a result, becoming smaller and without the spring actuating means being in the way of a connecting conductor having a large cross section. However, a greater distance between the resting point and the point of rotation means a more advantageous lever ratio and thus a lower actuating force for the user.

A preferred embodiment is characterized by the fact that the conductor bar has approximately a U-shape, the connecting end forming the one U-leg and the discharge area is formed by the crossbar and the other U-leg. In this arrangement, an upward bend for attaching other current conductors which lead into the interior of the installation switching device can be provided at the free end of the other U-leg.

According to a further embodiment, a discharge bar can also be moulded onto the free end of the other U-leg. The discharge bar can extend approximately perpendicularly to the other U-leg and the first side of the connecting end opposite to the clamping edge can be supported on the discharge bar.

A further advantage of an installation switching device according to the disclosure lies in the fact that the discharge area of the conductor bar can be used for electrical contacting during the calibration of the thermal bimetal. In previously known installation switching devices, the contact point for the calibration of the thermal bimetal is arranged at another point outside the access area of the terminal connection and is not accessible via the terminal connection. Since the thermal bimetal can only be calibrated in the completely assembled state, the separate access openings to the calibration contacts must be covered by additional cover parts after the calibration in known installation switching devices.

This is not necessary in an installation switching device according to the disclosure. Compared with the installation switching devices known in the prior art, this saves both assembly parts—namely the additional cover parts—and production steps in the assembly so that the resultant simplification of assembly results in a further advantage of the installation switching device according to the disclosure.

An installation switching device according to the disclosure can be completely assembled apart from the terminal cover part. The calibration of the thermal bimetal is then performed—by means of electrical contacting through the opening of the terminal connection—by using the discharge area of the conductor bar as calibration contact. After completed calibration, the terminal cover part is put in place and the installation switching device is thus completed. A separate cover part for the calibration opening is no longer required.

A further advantage is given by the fact that, due to the arrangement according to the disclosure, the terminal connections of an installation switching device according to the disclosure are constructed in such a manner that they only have a low electrical resistance even with very narrow external dimensions. This is achieved by the fact that the conductor bar has a uniform width in the discharge area between the clamping edge and the point at which a further current conductor is attached which leads into the interior of the installation switching device. This makes it possible to build up installation switching devices according to the disclosure also in half standard module width.

According to DIN 43 880, a module a is defined for the module width of installation switching devices. According to the standard, the module width is an integral or half-integral multiple of 17.5 mm, more precisely: $a=n\times(17.5\text{ mm}+0.5\text{ mm})$, n=0.5; 1.5; 1.5; 2.0, . . . .

An installation switching device having half a standard module width thus has a module width of 9 mm.

The conductor bar has only a single window-like opening for receiving also a number of connecting conductors. The individual connecting conductors which are received in an opening of the conductor bar are kept apart by the terminal openings and the guide means connected to these. It is thus possible to individually insert and remove a number of connecting conductors in only a single opening without the individual connecting conductors influencing each other.

This is made possible in an even better way in a further embodiment of the disclosure in which the clamping leg of the clamping spring is longitudinally slotted so that two part-springs are produced which are closely next to one another and are clampable independently of one another and which are allocated in each case to one terminal opening in the terminal cover part and thus in each case to one connecting conductor to be connected. Due to the fact that the two part-springs are close together, that is to say without having a separating, relatively large intermediate space or an intermediate web between them which is approximately in the centre, a further contribution is made towards a narrow construction of the terminal connection so that the terminal connection according to the disclosure can be installed in an installation switching device having only half a standard module width.

In the previously known installation switching devices, a separate opening, separated by a centre web, is provided in the conductor bar for each connecting conductor at the terminal connections. The terminal connections thus become so wide that, when two terminal connections are installed in one installation switching device of a standard module width, the two terminal connections must partially overlap. This impairs the required electrical insulation between the two terminal connections according to the prior art.

The disclosure makes it possible to be able to insert two terminal connections next to one another in an installation switching device of one standard module width, which are electrically insulated from one another and do not need to overlap. As a result, electrical crosstalk between the two adjacently located terminal connections is reliably avoided.

BRIEF DESCRIPTION OF THE DRAWINGS

The disclosure and further advantageous embodiments and improvements of the disclosure will be explained in greater detail and described with reference to the drawings, in which two illustrative embodiments of the disclosure are shown. In the drawings.

In the figures, identical or identically acting components or elements are in each case provided with identical reference numbers, even if they are arranged in slightly modified form in different variants of the embodiment.

DETAILED DESCRIPTION

Figure 1:
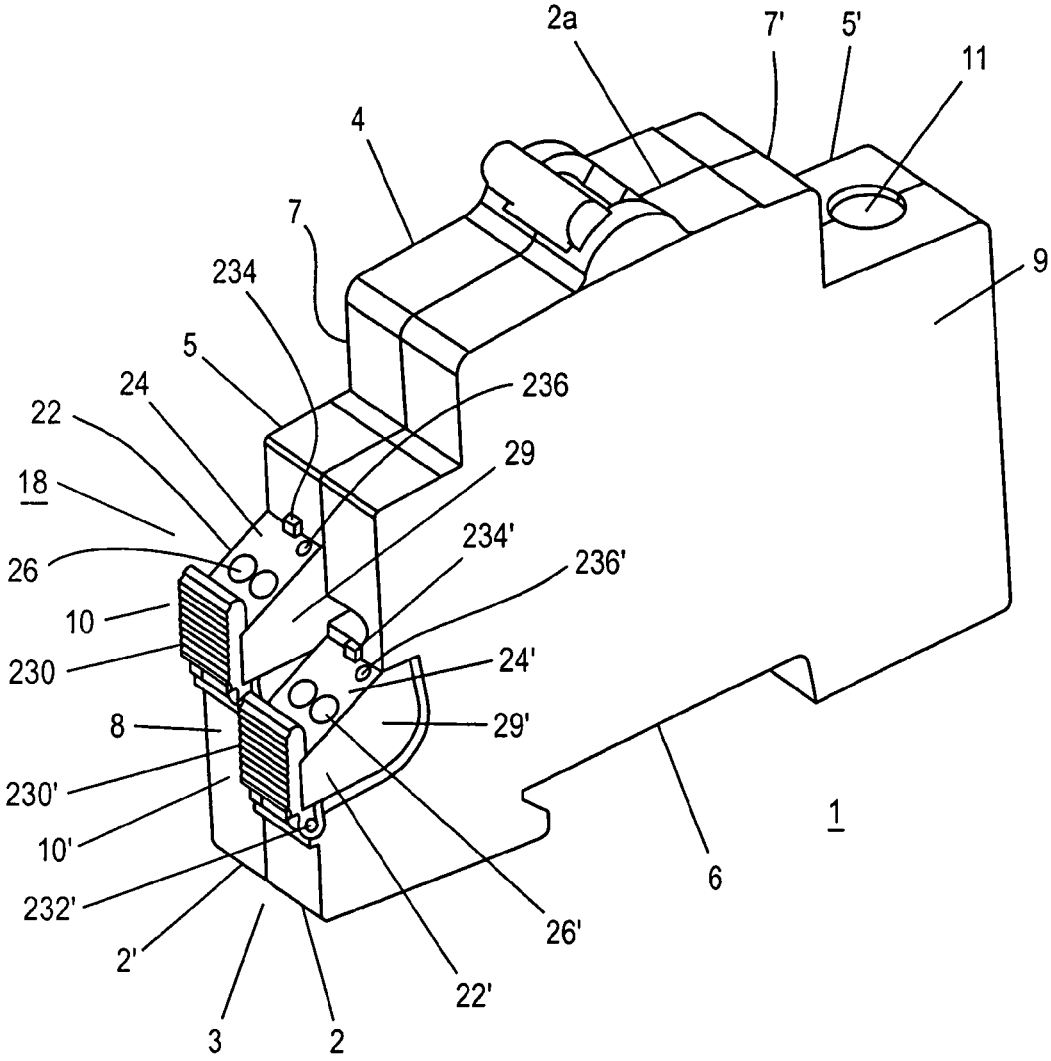
FIG. 1 shows a diagrammatic view of an installation switching device according to the disclosure.

Firstly, FIGS. 1 to 5 will be considered. An installation switching device 1 according to the disclosure, see FIG. 1, has a housing 3 of insulating material formed from two housing parts 2, 2' joined together along a plane of separation 2*a*, with a front face 4, rear faces 5, 5', a mounting or connecting side 6, front narrow sides 7, 7' which connect the front face 4 to the rear faces 5, 5', rear narrow sides 8, 8' and two wide sides 9, only one of which is shown in the view according to FIG. 1.

At one of the rear faces 5', a conventional screw terminal for connection of connecting conductors, which is accessible through a terminal opening 11, is attached in a terminal connection space attached within the housing 3.

At the second rear face 5, opposite the screw terminal, a terminal connection space 18 is provided which is open towards the housing wide sides 9, towards the rear narrow side 8 and towards the rear face 5. In the terminal connection space 18, two terminal connections 10, 10' are present which are displaced transversely to the wide side 9 next to one another and against one another in height above the mounting side 6. Seen from the mounting side 6, a first terminal connection 10 is thus located above a second terminal connection 10'. Each of the two terminal connections 10, 10' is fixed in position in the terminal connection space 18 and accessible for the connection of connecting conductors 14 (see FIG. 3). The openness of the terminal connection space on four sides provides increased flexibility for the direction of connection of the connecting conductors 14.

Each of the two terminal connections 10, 10' is covered by a terminal cover part 22, 22' allocated to it. This is used, on the one hand, as protection against contact of the current-conducting terminal connections and, on the other hand, as will be shown further below, it guarantees toolless actuation of the terminal connections.

Between the upper edge of the second terminal connection 10' and the rear face 5, the cover, pointing into the interior of the device, of the terminal connection space 18 is formed by a part-piece 8*a* of the housing wall.

Figure 2:
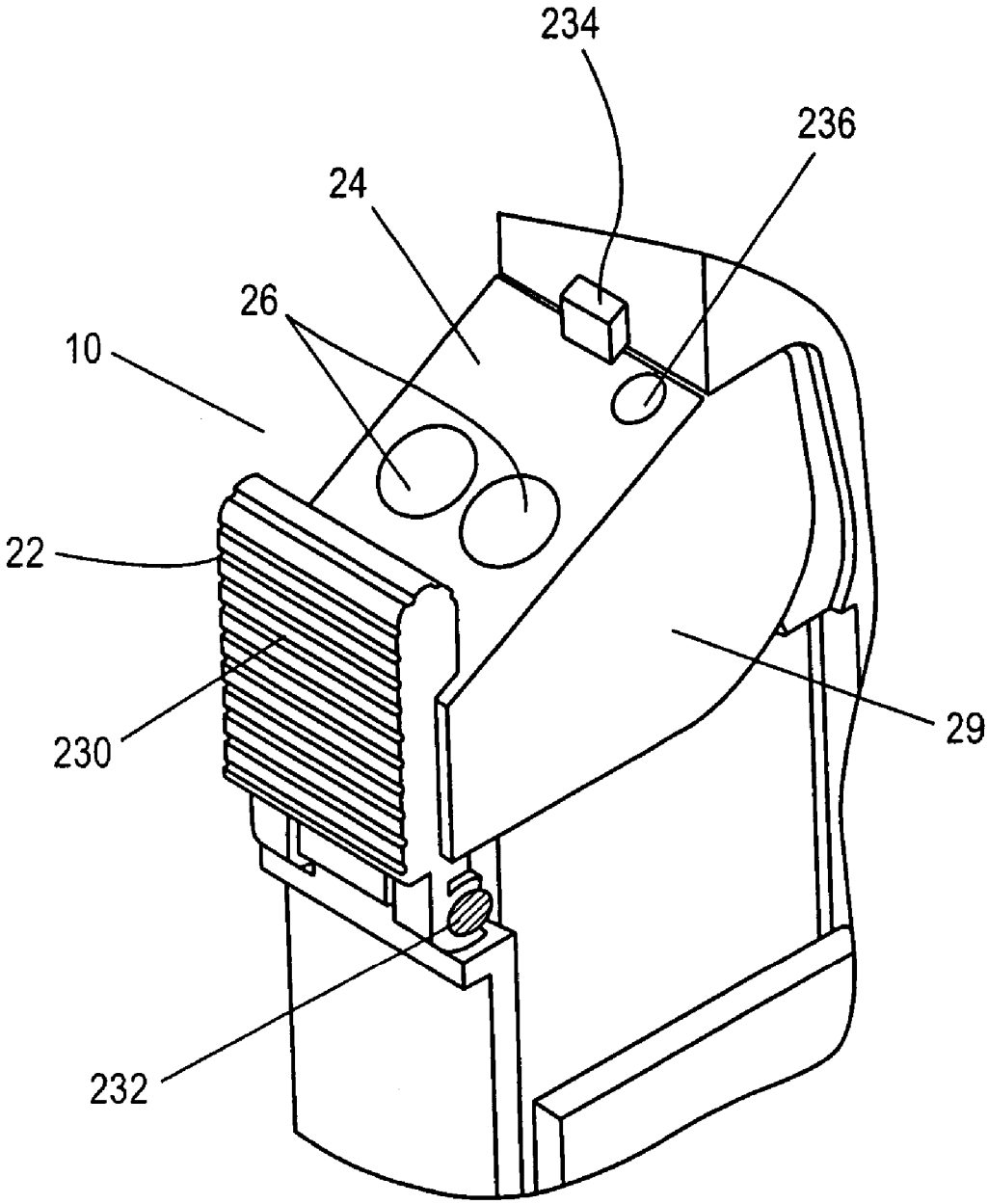
FIG. 2 shows an enlarged view of the upper terminal connection of the installation switching device according to FIG. 1 with the terminal cover in place.

The terminal cover part 22, 22' essentially has the form of a box open on two sides (see also FIG. 2, in which only the top terminal connection 10 is shown as section of FIG. 1). Two sides of this box are formed by two cover plates standing at an angle to one another, at which two side areas 29, 29' are moulded on laterally which cover the terminal connection 10, 10' laterally in the direction of the wide sides 9.

The first cover plate covers the associated terminal connection 10 or 10', respectively, towards the rear face 5 and has a terminal face 24 or 24', respectively, having in each case two terminal openings 26 and 26', respectively, wherein a connecting conductor can be connected through each of the terminal openings 26, 26'.

The second cover plate covers the associated terminal connection 10 and 10', respectively, towards the rear narrow side 8 and has a pressure area 230 or 230', respectively, which is accessible from the outside and which can be manually operated. At its free edge, the second cover plate has a half open tube-like cavity with which it is supported rotatably in a hinge pin 232 or 232', respectively, connected to the rear narrow side 8 of the housing 3.

Naturally, other types of rotatable support of the terminal cover part on the housing are conceivable, for example a rotatable rivet connection or also an articulated hinge connection.

Figure 4:
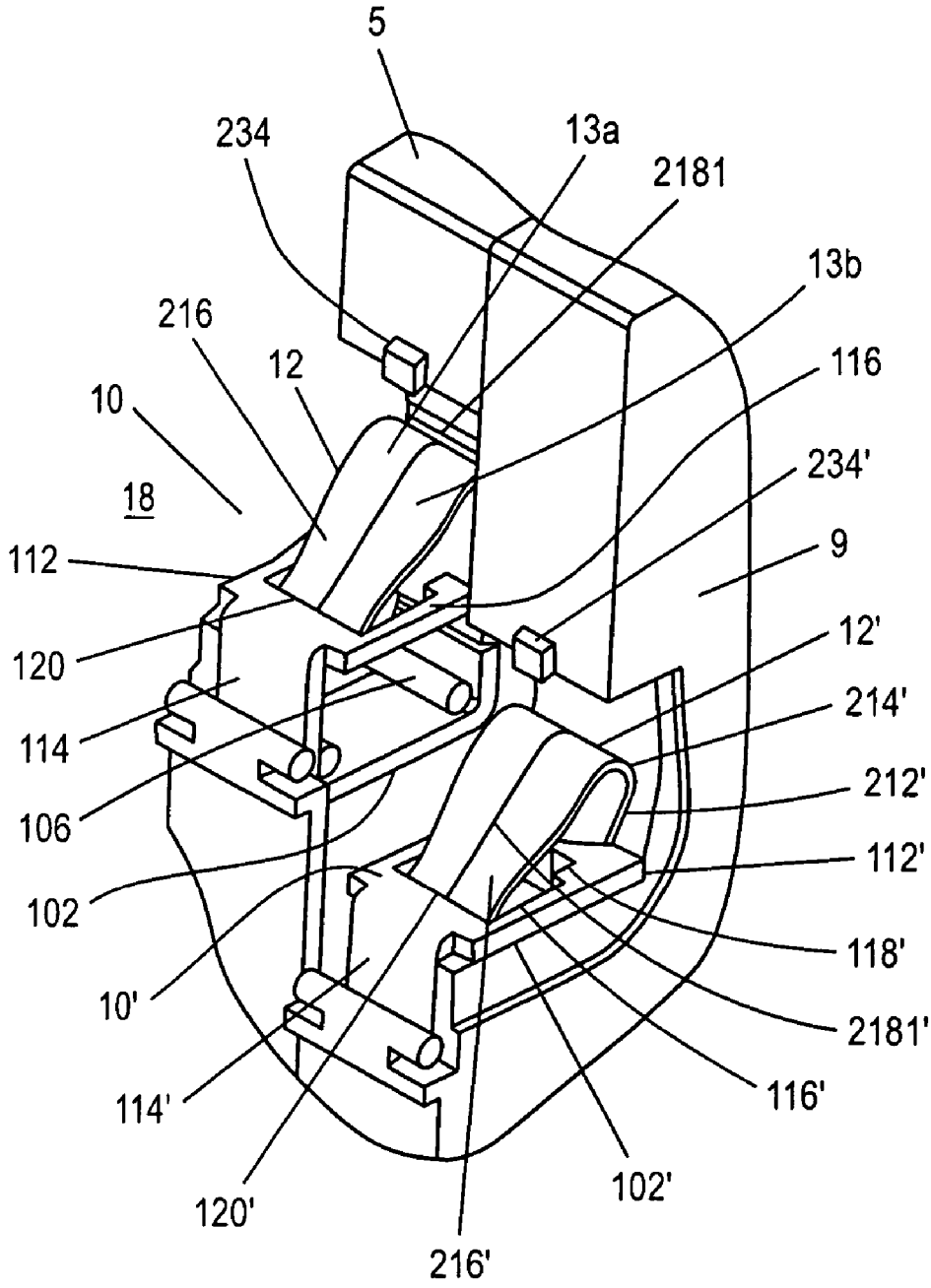
FIG. 4 shows a diagrammatic view of the terminal connection space according to FIG. 1, with terminal covers removed.

FIG. 1 shows an installation switching device 1 according to the disclosure with the terminal cover parts 22, 22', and FIG. 4 shows a view of the terminal connection space 18 with the terminal cover parts removed.

Each of the terminal connections 10 and 10', respectively, is a so-called plug-in terminal connection. Its structure will be explained with reference to FIG. 3 which shows the terminal connection 10 from FIG. 2 but with the side area 29 of the terminal cover part 22 removed, and by means of FIG. 4, in which the arrangement of the two terminal connections 10 and 10', respectively, in the terminal connection space 18 is shown. The reference numbers without apostrophe relate to the upper terminal connection 10, the reference numbers with apostrophe relate to the lower terminal connection 10'. In the text following, the reference numbers without apostrophe are not mentioned because of better legibility, but drawn in the figures. For the rest, the two terminal connections 10, 10' are essentially of identical construction.

The terminal connection 10 comprises a conductor bar 102 and a clamping spring 12. The terminal connection 10 rests on a projection, which is not shown in greater detail here, formed in the interior of the housing 3 and is there fixed in position in the terminal connection space 18 in a manner known per se by means of webs and pins, of which only a pin 106 is shown here by way of example.

The conductor bar 102 comprises a connecting end 112 and an adjoining discharge area 114. At the connecting end 112 it has a single window-like opening 116 with a support edge 118 and a clamping edge 120 opposite the support edge. The clamping edge 120 is located at the transition of the connecting end 112 into the discharge area 114.

The clamping spring 12 has a support leg 212 with which it is supported on the support edge 118 of the conductor bar 102. The support can be effected in such a manner that the support leg 212 has at its free end an upward bend with which it partially encloses the support edge for the purpose of supporting.

The support leg 212 is adjoined by an arc piece 214 which is adjoined by a clamping leg 216. The conductor end 16 of a connecting conductor 14 is inserted into the window-like opening 116 from the side of the arc piece 214 and can be clamped tight between the clamping leg 216 and the clamping edge 120 acting as abutment. In this arrangement, the free end of the clamping leg 216 passes through the window-like opening 116.

The clamping leg 216 of the clamping spring 12 is longitudinally slotted along a slot 218 so that two part-springs 13*a*, 13*b* are produced which can be clamped independently of one another and by means of which two connecting conductors 14 can be clamped on independently of one another.

The conductor bar 102 has an approximately U-shaped basic form, the connecting end 112 forming the first U-leg and the discharge area 114 being formed by a crossbar 220 and the second U-leg 222. At the free end of the second U-leg 222, an upward bend 224 is attached. At this upward bend 224, further connecting conductors can be attached by means of which the terminal connection 10 is connected to other assemblies within the switching device housing such as, for example, the tripping assemblies. In particular, the connecting conductors can be welded or hard-soldered to this upward bend and screwing on or riveting on is also possible.

A represented configuration of the conductor bar has the advantage that the forces acting on the terminal connection 10 during the insertion and detachment of the connecting conductor are absorbed by it as a closed system and thus forces acting on other elements of the installation switching device such as, for example, the housing, are reduced.

The conductor bar 102 can be produced in very large numbers inexpensively and simply and in a wide variety of shapes, for example as punched bent part.

The terminal cover part 22 can be swivelled around the free edge of the second cover plate in the direction of the clamping spring 12 by means of pressure on the pressure area 230. Falling-out of the cover part 22 is prevented by a projection 234 at the housing wall, which is used as a stop.

Figure 3:
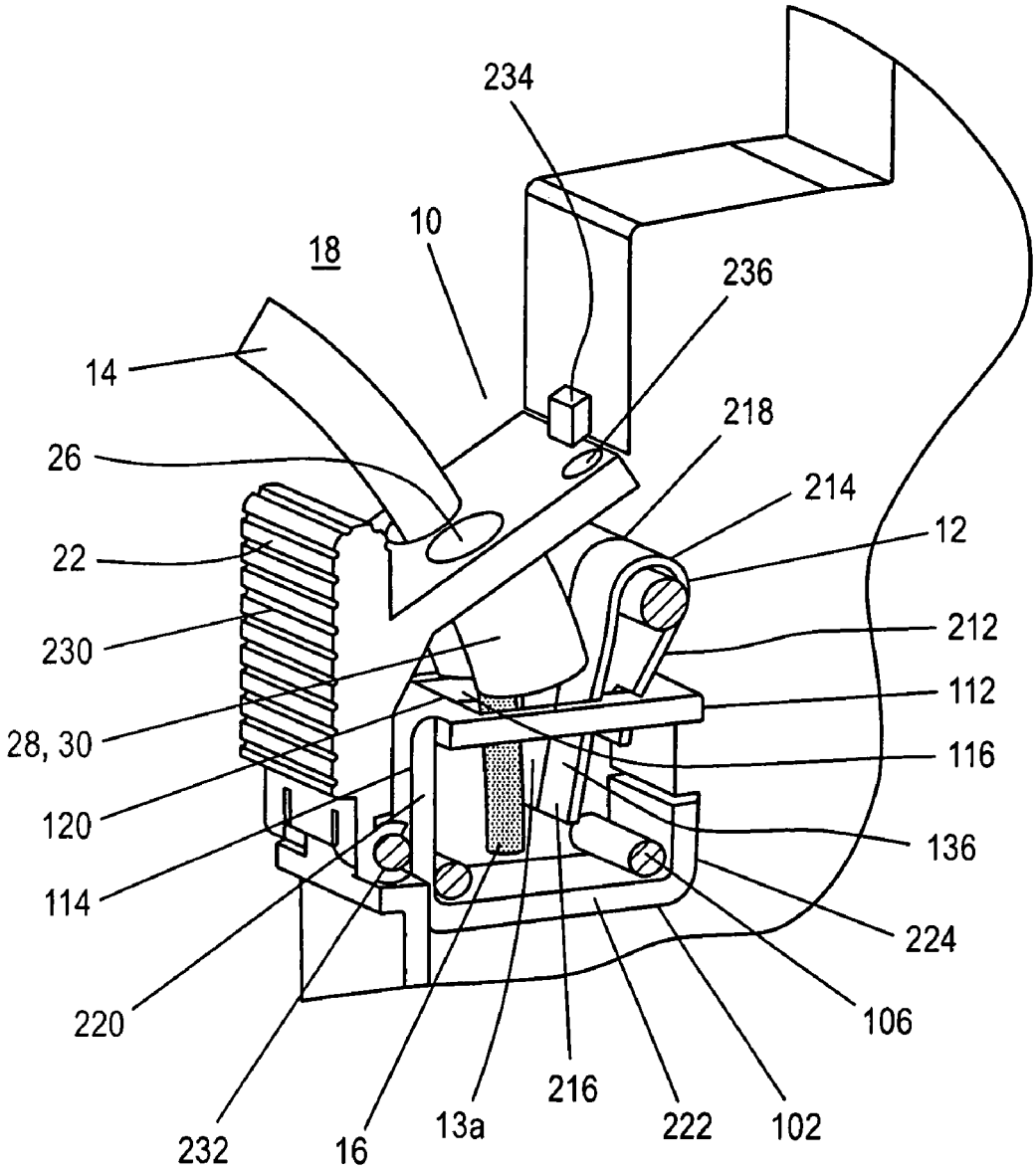
FIG. 3 shows a diagrammatic view into a terminal connection according to FIG. 2, the side wall of the terminal cover having been removed.

At the first cover plate of the cover part 22, tube-like hollow bodies 28 forming a lead-in conduit are attached at each of the terminal openings 26, aligned towards the clamping spring 12. These are used at the same time as guide means for the connecting conductor 14 to be inserted and as spring actuating means. When the cover part 22 is swivelled in the direction of the clamping spring 12 around the hinge pin 232 by pressure on the pressure area 230, the hollow bodies 28 press the clamping leg 216 in the clamping spring 12 away from the clamping edge 120 of the conductor bar 102 so that space for inserting the stripped connecting conductor end 16 of the connecting conductor 14 is produced between the clamping edge 120 and the clamping leg 216. FIG. 3 shows this condition.

If, after the insertion of the connecting conductor end, the pressure area 230 of the cover part 22 is released again, the clamping leg 216 of the clamping spring 12, due to its spring force, again presses the cover part 22 outward over the hollow bodies 28 and, at the same time, clamps the end 16 of the connecting conductor 14 against a clamping edge 120 of the window-like opening 116.

Naturally, connecting conductors having rigid connecting conductor ends can also be inserted without actuating the terminal cover part. This is because a rigid connecting conductor end can itself bend the corresponding part-clamping spring 13*a* or 13*b*, respectively, on insertion. However, actuation of the terminal cover part is required even in the case of rigid connecting conductor ends for removing the connecting conductor.

In the embodiment shown, two terminal openings 26 exist in the terminal face 24 of the cover part 22, and behind each terminal opening 26, a tubular hollow body 28 is located, moulded onto the terminal face, as guide means for the connecting conductor and as spring actuating means (only one of the hollow bodies 28 can be seen in the representation according to FIG. 3). In this arrangement, each terminal opening 26 and each guide means 28 is allocated to one of the two part-clamping springs 13*a*, 13*b* as have been produced by the slot 218 in the clamping spring 12. Thus, if two conductors are to be clamped on at a terminal connection, a conductor 14 is inserted through each of the two terminal openings 26 and clamped on by in each case one of the part-clamping springs 13*a*, 13*b*. The connecting conductors 14 are separated and guided in the hollow bodies 28 used as guide means for the connecting conductors 14 and thus no separate guiding or separating devices are required at the terminal connection. In particular, it is not required to subdivide the opening 116 into two receiving spaces by means of a web.

As a result, the terminal connection 10 can be constructed to be very simple and narrow. In this manner, two terminal connections can be installed next to one another in an installation switching device with a standard module width without the two terminal connections having to overlap. This is of advantage, for example, when one of the two terminal connections is allocated to one phase and the other terminal connection, arranged next to it, is allocated to the neutral conductor. It is then of particular importance that no electrical connection can be produced between the two terminal connections. If the terminal connections were not arranged in accordance with the disclosure, they would have to partially overlap in order to fit next to one another in an installation switching device housing of standard module width. As a result, however, there is a risk of electrical contact between the two terminal connections. By arranging the two terminal connections in accordance with the disclosure, a short circuit between the two terminal connections is reliably prevented even when the terminal connections are next to one another in one housing with a standard module width.

Due to the spring force of the clamping spring 12, the cover part 22 is pressed outward against the projection 234 in a state of rest so that the cover part always assumes a defined position in the state of rest.

The cover part thus fulfils two functions: on the one hand, the functions of guidance of the connecting conductors and, on the other hand, the function of the spring actuating tool. Both rigid and flexible conductor ends can be clamped in and also removed again from the terminal by means of the device according to the disclosure, without an external actuating tool for the clamping spring, and this at two terminal connections arranged next to one another.

Naturally, there could also be an additional slot in the terminal face 24 or in the pressure area of the cover part 22 through which an external tool could then be pushed for operating the clamping spring 12.

Furthermore, a test opening 236 is arranged in the terminal face 24. The clamping spring 12 can be electrically contacted by means of a test probe through this test opening.

In the embodiment shown in FIGS. 1 and 3, the terminal face 24 of the cover part 22 extends inclined towards the rear face 5. The guide means 28 are approximately perpendicular to the terminal face 24. The angle of inclination with which the connecting conductor 14 is introduced into the terminal is thus determined by the angle of inclination of the terminal face 24. An embodiment is also conceivable in which the terminal face 24 extends approximately in parallel with the rear face 5 and the guide means 28 are inclined with respect to the terminal face 24. The angle of inclination with which the connecting conductors 14 are inserted into the terminal is then determined by the angle of inclination of the guide means 28 with respect to the terminal face 24.

The cover part 22 can be produced very advantageously as a plastic injection moulding in one injection process.

Figure 6:
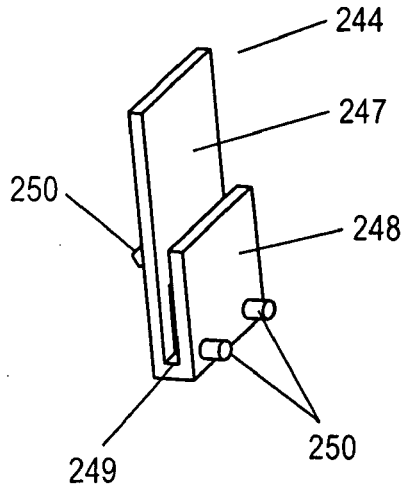
FIG. 6 shows an insulating plate for insertion into an installation switching device according to the disclosure according to FIG. 5.
Figure 5:
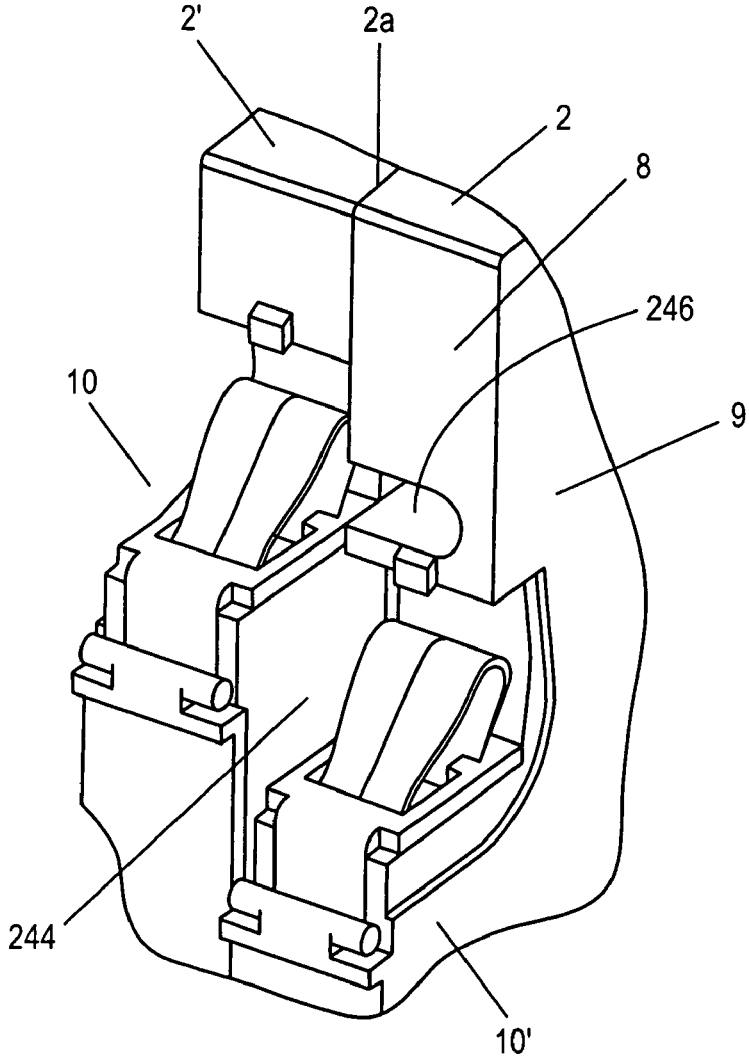
FIG. 5 shows a further embodiment of an installation switching device according to the disclosure with an insulating plate between the two terminal connections.

FIG. 5 shows a further embodiment of an installation switching device according to the disclosure in which an insulating plate 244 extending in parallel with the wide sides is inserted between the two terminal connections 10,10'. In FIG. 6, a particular embodiment of such an insulating plate 244 is shown. This accordingly essentially consists of two parallel plates 247, 248, having different lengths, which are joined by a web 249 at one free end so that, overall, a U-shape having two legs of different length is produced. The insulating plate 244 is inserted between the two terminal connections 10 and 10' in such a manner that the longer one of the two plates 247 covers the upper terminal connection 10 and the shorter one of the two plates 248 covers the lower terminal connection 10' towards the centre of the installation switching device. In addition, pins 250 are also attached at the plates 247, 248, by means of which the insulating plate 244 engages corresponding grooves on the inside of the housing parts 2, 2' and, as a result, is held undisplaceably between the two terminal connections 10, 10'.

Using an insulating plate 244 according to FIG. 5 prevents any contact, and thus an electrical contact between the two terminal connections 10, 10' even more reliably. In addition, the insulating plate acts in a mechanically stabilizing manner, for example it prevents the terminal connections 10, 10' from slipping transversely to the wide side 9 into the interior of the switching device.

Furthermore, an adjustment opening 246 is made in the part piece 8*a* of the housing wall above the lower terminal connection 10' in the embodiment according to FIG. 5. Through this opening, it is possible to intervene in the interior of the switching device with a tool from the direction of the terminal connection space, for example in order to access an adjustment means, for example an adjusting screw, arranged there in the vicinity of the adjustment opening 246.

The illustrative embodiments shown explain the disclosure by way of example. They are not intended to restrict the disclosure in any way to the illustrative embodiments shown there. Thus, it is also conceivable, for example, to arrange the two terminal connections next to one another without offset, that is to say at the same height with respect to the mounting side 6. Neither is the actual configuration of the terminal cover parts 22, 22' restricted to the box shape shown. Thus, in particular, the second cover plate could be longer than shown. Overall, the terminal connections 10, 10' could also be arranged at another position of the rear narrow side 8, for example oriented even farther in the direction of the mounting side 6.

The disclosure has been explained above with the example of an installation switching device in shell construction, in which two housing shells are joined along a plane of separation in parallel with the wide sides. Naturally, the disclosure can also be implemented in an installation switching device in pedestal design in which the housing is joined together from two parts along a plane of separation in parallel with the mounting side.

Similarly, embodiments of installation switching devices according to the disclosure are conceivable in which no additional screw terminal connection is provided but which exclusively have toolless terminal connections according to the disclosure. In this arrangement, the terminal connections can also be constructed as spring-pull or insulation displacement connections.

Figure 7:
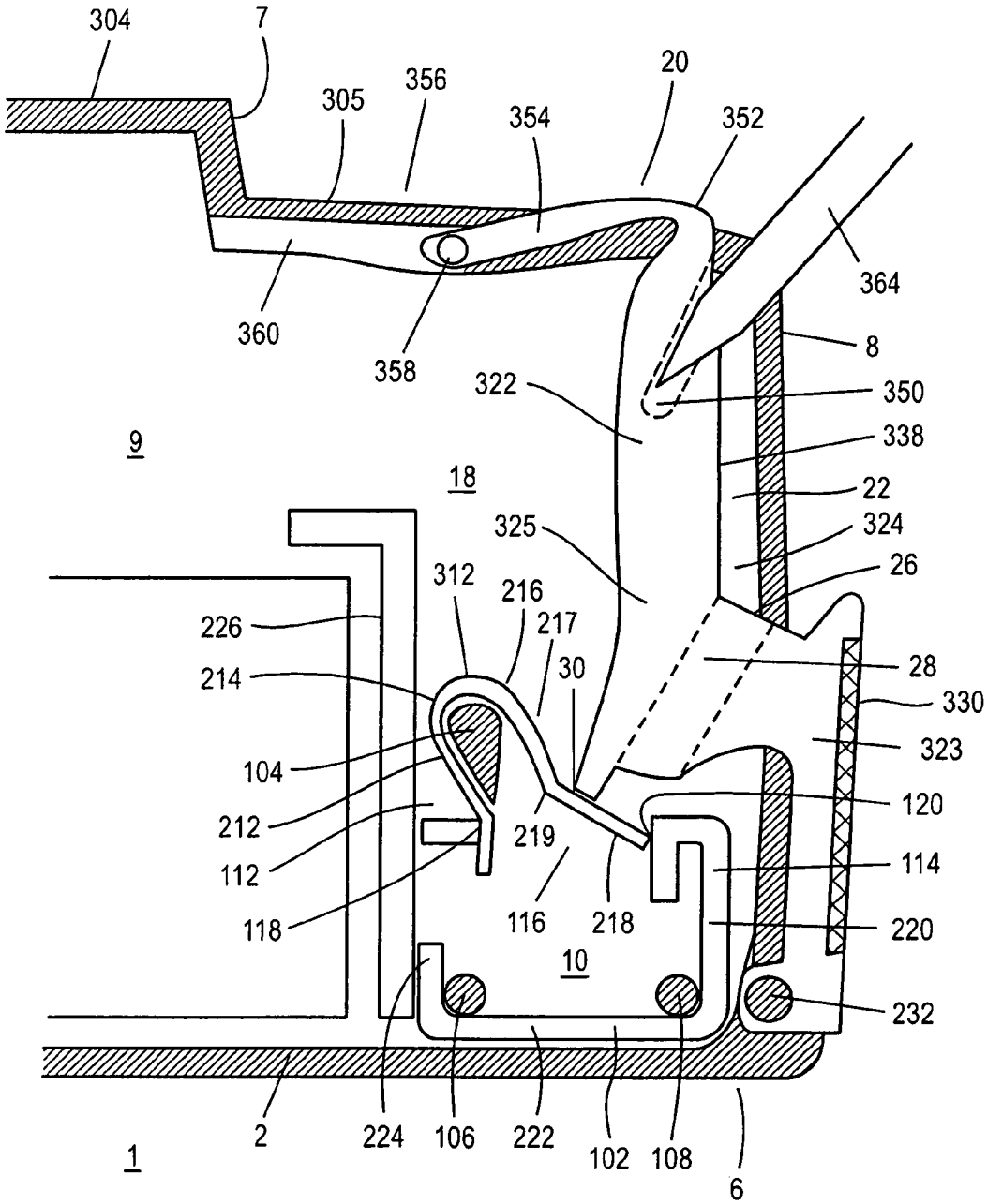
FIG. 7 shows a diagrammatic partial sectional view of a further embodiment of an installation switching device according to the disclosure which only shows the first lower terminal connection, with a terminal cover part at which a closing part is coupled via a hinge, with the terminal closed.
Figure 8:
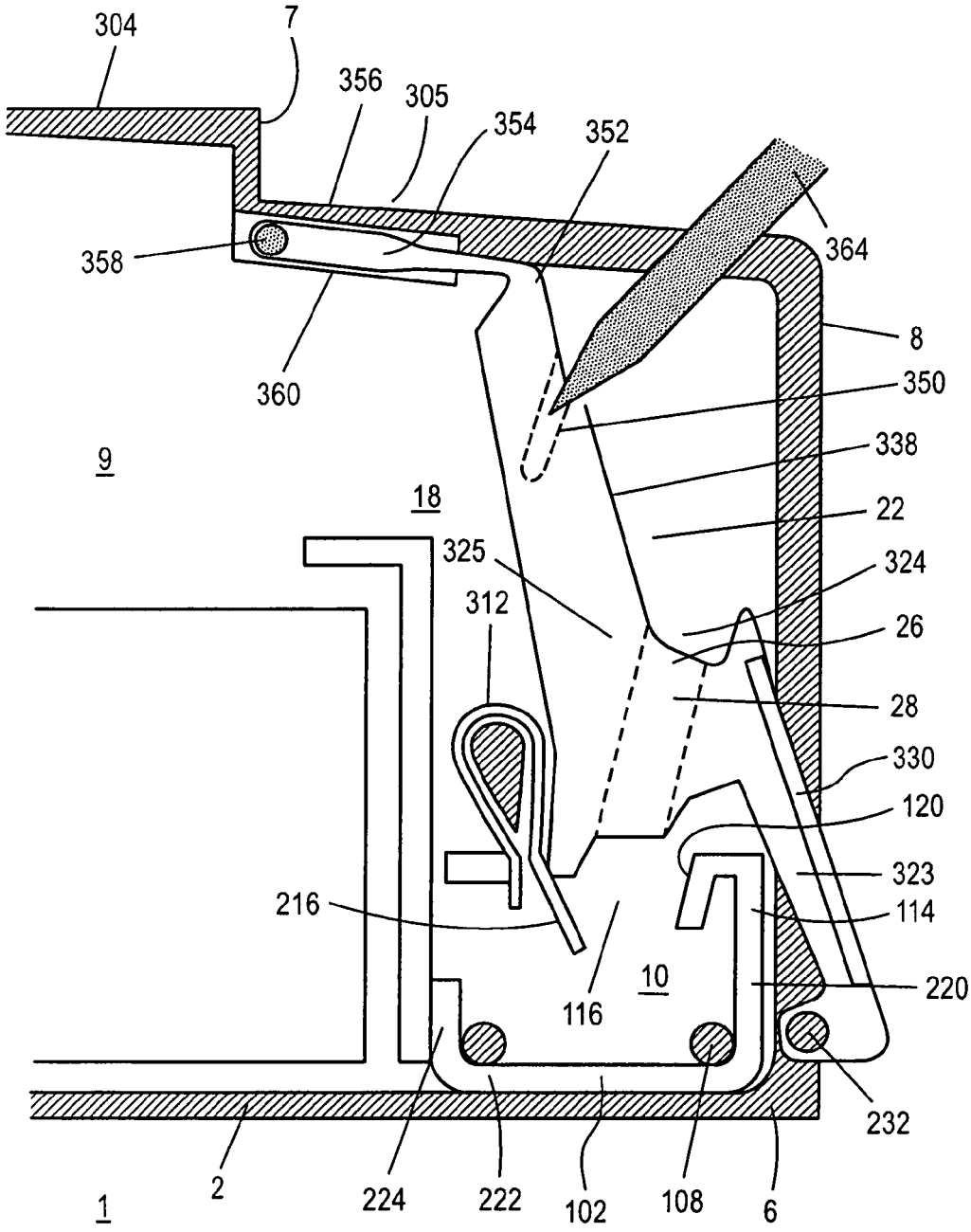
FIG. 8 shows a diagrammatic part-view of the installation switching device according to FIG. 7, with the terminal open in operated position.

FIGS. 7 and 8 will now be considered.

FIG. 7 shows a partial sectional view of the terminal connection space 18 of a further installation switching device 1 according to the disclosure. Only the first, lower terminal connection 10 is shown. The second, upper terminal connection 10' is correspondingly designed, but with a shortened spacing area of its associated second terminal cover part.

The installation switching device 1 has a housing of insulating material, formed of two housing parts 2, with a front face 304, a rear face 305, a mounting side 6, a front narrow side 7, a rear narrow side 8 and two wide sides 9, only one of which, located in the plane of the drawing, is shown in the view according to FIG. 1.

The terminal connection space 18 is limited laterally, that is to say towards the wide side, by the housing wide sides 9 of the housing of insulating material 3.

Towards the front face 304, an opening 20 of the terminal connection space 18 is formed by an opening in the rear face 305 of the housing part 2, through which the terminal connection 10, fixed in position in the terminal connection space 18, is accessible for the connection of connecting conductors 14. The front narrow side 7 is initially adjoined by a part piece 356, at the housing side, of the rear face 305. This produces an opening 20 at the rear face 305 in the area between the end of the part piece 356 at the housing side, facing away from the front narrow side 7, and the rear narrow side 8.

Due to a further opening at the rear narrow side 8 of the housing part 2, the opening 20 of the terminal connection space 18 extends beyond the contact edges between the rear narrow side 8 and the rear face 305 into the rear narrow side 8. This has the advantage that increased flexibility is given for the direction of connection of the connecting conductor 14.

The terminal connection 10 described in the text which follows essentially corresponds to the terminal connection already described above in FIGS. 1-6. It comprises a conductor bar 102 and a clamping spring 312. The terminal connection 10 is fixed in position in the terminal connection space 18, in a manner known per se, on the inside of the wide side 9 by means of webs 104 and pins 106, 108. The terminal connection 10, fixed in position in the terminal connection space 18, is located between the rear narrow side 8 and the rear mounting side 6 in the area of the contact edge.

The conductor bar 102 of the terminal connection 10 comprises a connecting end 112 and an adjoining discharge area 114. At the connecting end 112, it has a window-like opening 116 with a support edge 118 and a clamping edge 120 opposite the support edge 118. The clamping edge 120 is located at the transition of the connecting end 112 into the discharge area 114.

The clamping spring 12 has a support leg 212 with which it is supported on the support edge 118 of the conductor bar 102. It can be supported in such a manner that the support leg 212 has at its free end an upward bend with which it partially encloses the support edge 118 for the purpose of supporting it.

The support leg 212 is adjoined by an arc piece 214 which is adjoined by a clamping leg 216. The conductor end of a connecting conductor (not shown here) is inserted into the window-like opening 116 from the side of the arc piece 214 and can be clamped tight between the clamping leg 216 and the clamping edge 120, acting as abutment. The free end of the clamping leg 216 passes through the window-like opening 116.

The conductor bar 102 approximately has a U-shaped basic form, the connecting end 112 forming the first U-leg and the discharge area 114 being formed by a crossbar 220 and the second U-leg 222. At the free edge of the second U-leg 222, an upward bend 224 is attached. At this upward bend 224, further connecting conductors can be attached by means of which the terminal connection 10 is connected to other assemblies within the switching device housing such as, for example, the tripping assemblies. In particular, the connecting conductors can be welded on or hard-soldered onto this upward bend and screwing-on is also possible.

In the embodiment of a terminal connection which is shown in FIG. 1, the upward bend is elongated to form a discharge bar 226 at the free end of the second U-leg 222. The discharge bar 226 is thus positively connected with the second U-leg 222; it points approximately perpendicularly from the latter in the direction of the window-like opening 116 and projects over the latter.

In this embodiment, the arc piece 214 is first adjoined by a first part-clamping leg 27 which changes into a second part-clamping leg 218, bent away from the first part-clamping leg 217, at a bending edge 219 so that the first and the second part-clamping leg 217, 218 assume an obtuse angle with respect to one another. The opening of the obtuse angle points into the direction of insertion of the connecting conductor, the bending edge 219 is located approximately in the centre of the clamping leg 216.

The opening 20 of the terminal connection space 18 is covered by a terminal cover part 22 pivotably connected with the housing part 2.

The terminal cover part 22 comprises a first part-body 322, longitudinally extended in the direction of the rear narrow side 8 and coupled pivotably to the housing part 2 via a hinge pin 232, and a closing part 354 pivotably coupled to its free end via a hinge 352 which extends approximately in parallel with the rear face 305. To improve the mobility in the hinge 352, it is constructed as film hinge.

The first part-body 322 comprises a first cover plate 323 which covers the terminal connection space 18 in the lower part, adjoining the mounting side 6, of the narrow side 8 and which carries an approximately tube-like counterpiece to the hinge pins 232 with which it is coupled pivotably at the hinge pin. The first cover plate 323 has a pressure area 330 which is accessible from the outside and can be operated manually.

In the vicinity of the free end of the pressure area 330, the first cover plate 323 is connected via an intermediate piece 325, pointing into the interior of the housing, with a spacing area 338 which also extends in parallel with the rear narrow side 8 in the direction of the face 305 and covers the terminal connection space 18 in the upper part of the narrow side 8, adjoining the rear face 305.

At the free end of the spacing area 338, the aforementioned film hinge 352 with the closing part 354, coupled pivotably thereto, is located.

This is a plate which, at its free end, overlaps at least partially the part 356 at the housing side of the rear face 305. The closing part 354 and the part 356 at the housing side of the rear face thus together form the rear face 305.

At its free end, the closing part 354 carries pins 358 standing away laterally, pointing in the direction of the wide sides 9. In the housing, a rocker-like guide 360 is attached closest to the part 356 at the housing side of the rear face 305, in such a manner that the pins 358 are accommodated in the guide 360.

If then the terminal cover part 22 is swivelled in the direction of the interior of the device by pressure on the pressure area 330, the closing part 354 will slide behind the part 356 at the housing side of the rear face 305, and is guided by the rocker-like guide 360 displaceably in parallel with the latter. During this process, the angle changes between the closing part 354 and the spacing area 338.

Thus, the closing part 354 and the spacing area 338, in the closed position according to FIG. 7, form an acute angle with one another which is open towards the interior of the housing. In the position according to FIG. 2, the closing part 354 and the spacing area 338 form an obtuse angle with an opening into the interior of the housing when the terminal cover part 22 is swivelled into the interior of the housing.

On actuation of the terminal cover part and the associated swivelling about the hinge pin 232, the closing part 354 and the spacing area 338 also perform a swivelling movement with respect to one another around the film hinge 352.

By attaching the film hinge between the closing part 354 and the spacing area 338, the closing part 354 can thus shift approximately parallel behind the part 356 at the housing side of the rear face 305, in a space saving manner.

The intermediate piece 325 has a terminal face 324 pointing towards the outside. There is at least one terminal opening 26 in the terminal face 24. Starting from the terminal opening 26, a tube-like opening 28 passes through the intermediate piece 325, which penetrates the intermediate piece 325 approximately perpendicularly starting from the terminal face 324 and is thus used as guide means for a connecting conductor to be connected to the terminal connection 10.

The connecting conductor is guided through the terminal opening 26 in the terminal cover part 22 and, after leaving the tube-like opening 28, encounters the clamping leg 216 of the clamping spring 312.

If the connecting conductor is a rigid conductor, the clamping leg 216 of the clamping spring 312 can be pressed away from the clamping edge 120, by means of the connecting conductor alone, to such an extent that the connecting conductor can be inserted and clamped tight in the window-like opening 116 between the free end of the clamping leg 216 and the clamping edge 120.

In the case of a flexible connecting conductor, the window-like opening 116 must first be opened in another way.

This is done by swivelling the terminal cover part 22.

In the vicinity of the tube-like opening 28, the terminal cover part 22 carries at the intermediate piece 325 a nose 30, pointing towards the clamping leg 216, which is used as spring actuating means.

Naturally, the nose 30 can also be other protruding components, in particular, the function of the nose 30 could also be formed by a web surrounding the exit opening of the tube-like opening 28 in the manner of a collar.

Due to the restoring spring force of the clamping leg 216, the latter presses the nose 30, and thus the terminal cover part 22, towards the outside.

The terminal cover part 22 is swivelled inward by pressure on the pressure area 330 or on the spacing area 338, and the clamping leg 216 is pressed away from the clamping edge 120 via the nose 30 to such an extent that the window-like opening 116 becomes free for inserting the connecting conductor, see FIG. 8.

The nose 30 is moulded onto the terminal cover part 22 and constructed in such a manner that, when the cover part is swivelled against the clamping spring, it loads it to open close to the bending edge 219.

Due to its alignment in such a manner that it loads the clamping spring to open close to the bending edges when the cover part is swivelled, less force expenditure is required during the opening actuation of the terminal cover part, the opening area in the clamping window remaining of the same size.

In an actual example, the first and second part-clamping leg 217, 218 form an angle of approximately 160°. With respect to a clamping spring with straight unbent clamping leg 216, otherwise unchanged, the introduction of the angle halves the actuating force with maximum terminal aperture.

A corresponding procedure is adopted for detaching a connecting conductor clamped on. Pressure on the terminal cover part 22 detaches the clamping between the clamping leg 216 and the connecting conductor in the manner described above so that the latter can be pulled out of the window-like opening 116. Due to the kinked construction of the clamping leg 216, described above, the actuating force for detaching the connecting conductor is also much lower.

The corresponding procedure is adopted for detaching a connecting conductor clamped on. Pressure on the terminal cover part 22 detaches the clamping between the clamping leg 216 and the connecting conductor in the manner described above, so that the latter can be pulled out of the window-like opening 116.

As an alternative, the opening movement of the terminal cover part 22 can also be effected by a commercially available longitudinal-slot or crossed-slot screwdriver 364. For this purpose, the latter is placed into a receiving opening 350, suitable for reception (slot-, cross-shaped or spherical opening) at the spacing area 338 at an acute angle and the terminal is opened by a pressure movement with the screwdriver 364.

Even if only one terminal opening 26 and only one tubular opening 28 are shown in the representation according to FIGS. 7 and 8, two or more such terminal openings can actually also be provided for receiving and connecting a number of connecting conductors in the intermediate piece 325. All connected connecting conductors can be clamped on with a common clamping spring via its clamping legs 216. When the terminal cover part 22 is actuated, all connected conductors are then released simultaneously and can be detached simultaneously.

In a further embodiment, to which, however, the same FIGS. 7 and 8 apply as diagrammatic drawings, the terminal cover part 22 with the first part-body 322, the hinge 352 and the closing part 354 consists of two material components having different mechanical properties.

These are joined to one another in a two-component injection moulding process.

The result is then a hard/soft compound. The hard component forms the major component. The first part-body 322 is produced from this. It is used for transferring the actuating forces to the clamping spring 312 and during this process preventing or at least minimizing a bending-through of the component.

The soft component is used in the area of the hinge 352 and of the closing part 354.

This provides for easy mobility of the hinge which is required so that the angular change of the angle between the closing part 354 and the first part-body 322 on actuation of the terminal cover part 22 as described above can be easily adjusted.

In this embodiment, the hinge 352 does not necessarily have to be a film hinge. This is because the mobility of the hinge is ensured by the choice of a flexible material in the hinge area and not by the thickness of the hinge alone.

Flexibility of the closing part 354 also contributes to the latter being able to bend to some extent when it is displaced in parallel with the rear face 305 towards the front narrow side 7 in the rocker-like guide 360, and can thus rest against the front narrow side 305 even more easily and narrowly.

Overall, this leads to a very close guidance of the closing part 354 at the rear face 305, and thus to great space saving during the swivelling of the terminal cover part 322.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE DESIGNATIONS

1 Installation switching device
10, 10' Screwless terminal connection
102, 102' Conductor bar
Web
106 Pin
108 Pin
11 Opening for screw terminal
110 Projection
112, 112' Connecting end
114, 114' Discharge area
116, 116' Window-like opening
118 Support edge
12, 12' Clamping spring
120, 120' Clamping edge
13*a, b* Part-spring
14 Connecting conductor
16 Stripped connecting conductor end
18 Terminal connection space
2 Housing part, housing
2' Housing part
20 Terminal connection space opening
212 Support leg
212' Support leg
214 Arc piece
214' Arc piece
216 Clamping leg
216' Clamping leg
217 First part-clamping leg
218 Second part-clamping leg
2181' Slot
2181 Slot
219 Bending edge
22 Cover part, terminal cover part
22' Cover part, terminal cover part
220 Crossbar
222 Second U-leg
224 Upward bend
226 Discharge bar
228 Upward bend
230 Pressure area
230' Pressure area
232 Hinge pin
232' Hinge pin
234 Projection
234' Projection
236 Test opening
236' Test opening
238 Spacing area
24 Terminal face
24' Terminal face
240 Second operating area
242 Insulating web
244 Insulating plate
246 Adjustment opening
247, 248 Plate
249 Web
26 Terminal opening
26' Terminal opening
28 Guide means, tube-like opening
29, 29' Side area
2*a* Plane of separation
3 Housing
30 Spring actuating means, nose
304 Front face
305 Rear face
312 Clamping spring
322 First part-body
323 First cover plate
324 Terminal face
325 Intermediate piece

330 Pressure area
338 Spacing area
350 Access opening
352 Hinge
354 Closing part
356 Part at the housing side of the rear face
358 Pin
360 Rocker-like guide in the inner wide side
364 Screwdriver
4 Front face
5 Rear face
6 Mounting side
7 Front narrow side
8 Rear narrow side
8' Rear narrow side
8*a* Part piece of the housing wall
9 Wide side

What is claimed is:

1. Installation switching device comprising a housing, with a front and rear face, a mounting side, front and rear narrow sides and wide sides, and with two screwless terminal connections with in each case at least one clamping spring for the connection of connecting conductors which are fixed in position in a terminal connection space of the housing, wherein the terminal connection space is open towards the housing wide sides and towards the face, that each terminal connection is covered by an associated terminal cover part connected pivotably to the housing, which has a terminal face with a number of terminal openings corresponding to the number of connecting conductors to be connected, and guide means moulded onto each terminal opening for the connecting conductors, which also has two side areas which cover the terminal connection laterally in the direction of the wide sides.

2. Installation switching device according to claim 1, wherein spring actuating means are moulded onto each cover part and are constructed in such a manner that, when the cover part is swivelled against the respective clamping spring they load the latter so as to open it.

3. Installation switching device according to claim 2, wherein the guide means are tube-like hollow bodies forming a lead-in conduit, which, at the same time, are used as spring actuating means for the clamping spring.

4. Installation switching device according to claim 1, wherein the two terminal connections are displaced next to one another transversely to the wide side and against one another in height above the mounting side.

5. Installation switching device according to claim 1, wherein each terminal cover part is resiliently loaded by its associated clamping spring in opposition to the direction of insertion of the external connecting conductor and can be pressed against the clamping spring.

6. Installation switching device according to claim 5, wherein each cover part is resiliently loaded by its associated clamping spring against a projection, used as stop, of the housing wall.

7. Installation switching device according to claim 1, wherein each terminal cover part has a pressure area which is accessible from the outside and can be manually operated.

8. Installation switching device according to claim 1, wherein the terminal connection space comprises between the two terminal connections an insulating plate extending in parallel with the wide sides.

9. Installation switching device according to claim 1, wherein the terminal cover part has a test opening for electrically contacting the terminal connection.

10. Installation switching device according to claim 1, wherein an adjustment opening is introduced in the rear housing wall in the vicinity of a terminal cover part.

11. Installation switching device according to claim 1, wherein the terminal cover part has an access opening for an actuating tool.

12. Installation switching device according to claim 1, wherein a closing part, which covers the terminal connection space at the face in collaboration with a housing-fixed face end, is coupled pivotably to the free end, pointing towards the face, of a first part-body of each terminal cover part, wherein the closing part at least partially overlaps the housing-fixed face end on actuation of the terminal cover part.

13. Installation switching device according to claim 12, wherein the closing part is coupled to the terminal cover part by means of a hinge.

14. Installation switching device according to claim 12, wherein the closing part is guided displaceably over guide pins, projecting laterally, in a housing-fixed rocker-like guide.

15. Installation switching device according to claim 12, wherein the terminal cover part, following the terminal face, carries a spacing area which forms the closure, at the side of the terminal cover part, of the terminal receiving space in the area of the narrow side, the closing part being pivotably coupled to the end, pointing towards the face, of the spacing area.

16. Installation switching device according to claim 12, wherein the closing part consists, at least in the area of the coupling to the first part-body, of a material which has different mechanical properties from the first part-body of the terminal cover part.

17. Installation switching device according to claim 13, wherein the hinge and the closing part consist, in the area of the hinge, of a material which has different mechanical properties from the first part-body of the terminal cover part.

18. Installation switching device according to claim 15, wherein the spacing area is constructed to be stiff and that the closing part is constructed to be softer than the spacing area at least in the area of the coupling to the spacing area.

19. Installation switching device according to claim 17, wherein the terminal cover part with the closing part coupled thereto is produced in a two-component injection moulding process.

20. Installation switching device according to claim 1 comprising in each case a clamping spring, acting as compression spring on the conductor end, for clamping a conductor end to an abutment, wherein each terminal connection comprises a conductor bar with a connecting end and an adjoining discharge area, each conductor bar has at the connecting end a window-like opening with a support edge and a clamping edge opposite to the support edge at the transition of the connecting end into the discharge area, each clamping spring has a support leg by means of which it is supported on the support edge of the conductor bar, and the support leg is adjoined by an arc piece which is adjoined by a clamping leg so that the conductor end can be clamped tightly between the clamping leg and the clamping edge as abutment.

21. Installation switching device according to claim 20, wherein the arc piece is adjoined by a first part-clamping leg which merges into a second part-clamping leg bent away from the first part-clamping leg at a bending edge so that the first and the second part-clamping leg assume an obtuse angle to one another, the opening of which points in the direction of insertion of the connecting conductor.

22. Installation switching device according to claim 20, wherein each conductor bar approximately has a U-shape, the connecting end forming one U-leg and the discharge area being formed by a crossbar and the other U-leg.

23. Installation switching device according to claim 22, wherein a discharge bar which extends approximately perpendicularly to the other U-leg is moulded onto the free end of the other U-leg and the side of the connecting end opposite to the clamping edge is supported on the discharge bar.

24. Installation switching device according to claim 20, wherein the clamping leg of each clamping spring is longitudinally slotted so that in each case two part-springs, which are clampable independently of one another, are produced which are in each case allocated to one terminal opening in each terminal cover part.

* * * * *